United States Patent [19]

Wirth

[11] 4,279,060

[45] Jul. 21, 1981

[54] METHOD OF AND APPARATUS FOR THE PRODUCTION OF OPEN NON-WOVEN FABRIC FROM FIBROUS MATERIAL

[75] Inventor: Walter Wirth, Dülmen, Fed. Rep. of Germany

[73] Assignee: Hergeth KG Maschinenfabrik und Apparatebau, Dülmen, Fed. Rep. of Germany

[21] Appl. No.: 54,646

[22] Filed: Jul. 3, 1979

[30] Foreign Application Priority Data

Jul. 11, 1978 [DE] Fed. Rep. of Germany ..... 2830367

[51] Int. Cl.[3] ..... D01G 15/50

[52] U.S. Cl. ..... 19/106 R; 19/296

[58] Field of Search ..... 19/98, 99, 100, 101, 19/106 R, 108, 296

[56] References Cited

U.S. PATENT DOCUMENTS 3,256,569 6/1966 Draving ..... 19/106 R

FOREIGN PATENT DOCUMENTS 171929 1/1952 Austria ..... 19/106 R 2723919 8/1977 Fed. Rep. of Germany ..... 19/106 R

*Primary Examiner*—Louis Rimrodt

*Attorney, Agent, or Firm*—Diller, Ramik & Wight

[57] ABSTRACT

This disclosure relates to a novel method of and apparatus for producing an open non-woven fabric from fibrous material by delivering the fiber flocks through a carding zone during which time the fiber flocks are loosened and spread to form a non-woven fabric, subjecting the spread-out non-woven fabric to a jamming effect in a jamming zone downstream of the carding zone to form a non-woven fabric of matted fibers, and releasing the jamming effect to form an open non-woven fabric.

13 Claims, 3 Drawing Figures

METHOD OF AND APPARATUS FOR THE PRODUCTION OF OPEN NON-WOVEN FABRIC FROM FIBROUS MATERIAL

The present invention relates to a method of and appparatus for the production of open non-woven fabric from fibrous material, e.g., wool, cotton, man-made fibers, and the like, by means of a carding operation by loosening fiber flocks and spreading the same out to form a non-woven fabric which is subjected to a jamming effect to form a non-woven fabric of matted fibers, after of which the jamming effect is released to form a open non-woven fabric.

Conventionally, coherent non-woven fabrics are formed by a carding engine or card and are removed therefrom by a stripper device, e.g., a stripper roller, oscillating comb and the like, and the resultant fabric is composed predominantly of lengthwise-aligned fibers which, therefore, have a considerably lower strength in the cross direction than in the direction of length. In order to strengthen the cross direction or to achieve a higher lateral strength of the non-woven fabric, it is conventional to utilize lapping devices or lap layers which superpose one or more non-woven fabrics crosswise. However, expensive mechanical equipment is necessary for the latter purpose, and lightweight non-woven fabrics of satisfactory uniformity can be produced in the latter manner only with considerable difficulty. With the increased use on non-woven products in many branches of manufacture, an improvement of the lateral resistance of matted strength of non-woven fabrics produced by carding engines or cards is, therefore, very much desired.

In keeping with the foregoing, an object of this invention is to achieve the production with structurally simple means of non-woven fabrics of matted fibers, the lateral resistance of which is improved relative to the conventional non-woven fabrics produced on conventional cards or carding engines. The invention is characterized in that the spread-out non-woven fabric from the carding engine is subjected to a jamming effect downstream of the carding zone and is thereafter exposed over a short distance of predetermined length of a free zone or an expansion zone for the formation of open non-woven fabric which is thereafter delivered in a manner conventional in a carding operation.

In accordance with this invention, it is possible to obtain directly during the carding operation a non-woven fabric with increased lateral strength, namely, in a continuous working operation in combination with the carding procedure. Every kind of non-woven fabric can be converted in simple manner into a non-woven fabric of matted or laterally strengthened fibers. This applies especially to lightweight non-woven fabrics, and the latter is accomplished in a continuous, uninterrupted working operation.

In accordance with a further object of this invention, the apparatus for producing a non-woven fabric with matted fibers with increased lateral strength in conjunction with carding equipment is provided with a toothed cylinder between the carding cylinder and the stripping roller, along with a guide plate associated with the intermediate toothed cylinder. The intermediate toothed cylinder and the guide plate define a converging path of travel which diminishes in the direction of fabric or fiber feed, and the guide plate is so disposed that it terminates at a distance of predetermined length upstream of the connecting line between the centers of the toothed intermediate roller and the stripper roller in order to form a free or expansion zone for the formation of open non-woven fabric. The guide place functions to achieve a jamming effect which creates non-woven fabric of matted fibers with the fibers being prevented from becoming loose from the clothing and thereby being lost from the intended flow of fibers which might otherwise occur because of the strong centrifugal forces brought about by the high surface speed of the intermediate toothed roller.

Thus, in keeping with the foregoing, the non-woven fabric which comes from the carding engine or carding cylinder is subject to a certain degree of jamming between the intermediate toothed roller and the guide plate as the space therebetween diminishes progressively in the direction of fabric feed. However, downstream and beyond the guide plate there is located a free zone or an expansion zone in which there is a sudden cessation of the jamming effect and, thus, some of the fibers become loose from the teeth of the intermediate toothed roller under the influence of the influence of the centrifugal forces and move in free flight on an adjacent stripper roller where they make up on the surface of the stripper roller a matted layer of the fibers in the non-woven fabric or, states otherwise, an open non-woven matted fabric. The remainder of the fibers are stripped off in the usual manner in carding machines, i.e., the fiber material is compressed in the stripper clothing of the stripper roller. In this manner, the apparatus for forming an open non-woven fabric of matted fibers is, thus, integrated in the carding engine or machine and a conventional carding engine can, therefore, be appropriately converted so that in existing carding machines the equipment for producing open non-woven fabric of matted fibers can be subsequently installed in accordance with this invention without difficulty.

Advantageously, the rotational speeds from the carding cylinder to the intermediate toothed roller increases which, on the one hand, increases the jamming effect or action between the intermediate toothed roller and the guide plate and, on the other hand, the formation in the zone of formation of a non-woven fabric propitious to the forming of the matted fiber layer along the non-woven fabric. The toothing or teeth of the intermediate toothed roller (between the carding cylinder and the stripper roller) preferably has a front rake of zero degrees and on occasion of only a few angular degrees. This likewise has a favorable influence on the formation on the non-woven fabric of matted fibers which is also augmented in the free zone (beyond the guide plate) by an air intake or suction device which renders still more effecient the formation of the non-woven fabric.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
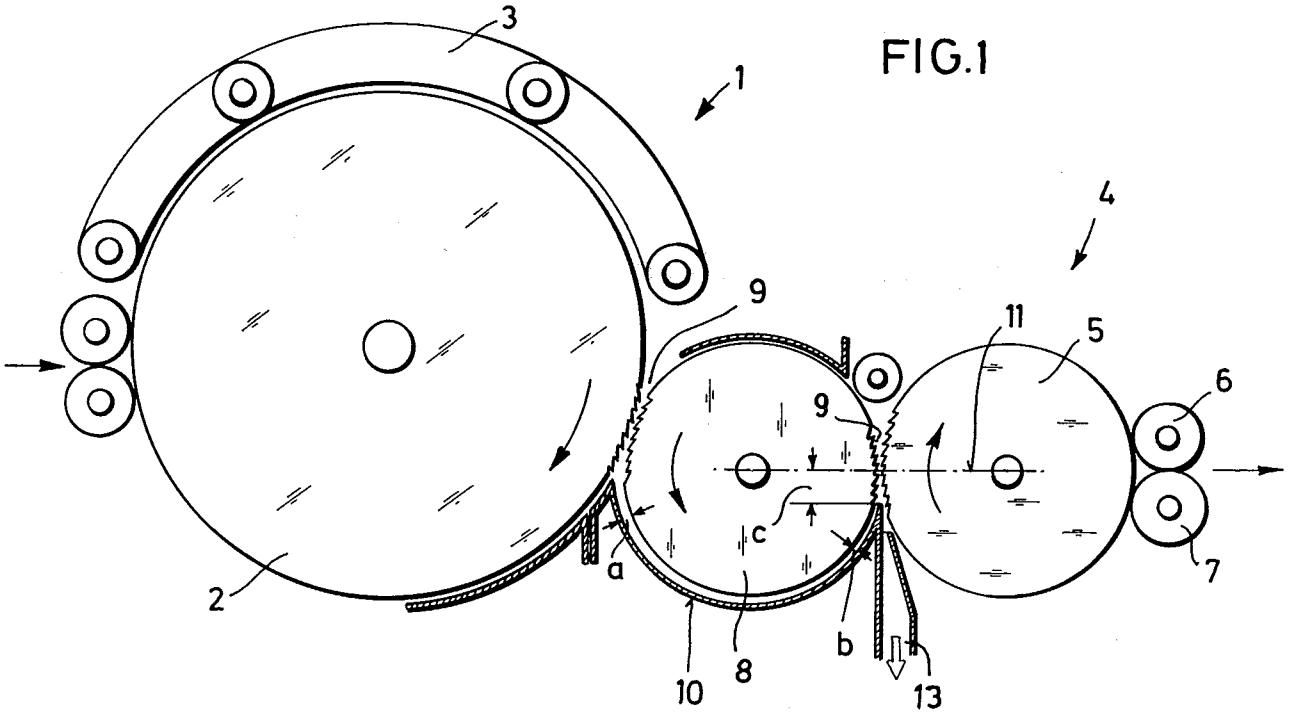
FIG. 1 is a shematic side elevational view of the novel apparatus of this invention, and illustrates a carding cylinder, a toothed intermediate roller associated with a guide plate, and a free zone between the end of the guide plate and aligned between the centers of the toothed intermediate roller and a stripper roller.

Reference is first made to FIG. 1 of the drawings which illustrates a novel apparatus 1 of this invention for the production of open non-woven fabric from fibrous material which includes carding means in the form of a conventional carding cylinder 2 which interacts in a conventional manner with covers 3 and/or a series of working rollers and clearer rollers (unnumbered) associated therewith. The apparatus 1 has been illustrated in FIG. 1 having but a single carding cylinder 2 and associated covers 3 and the series of working rollers (unnumbered) associated therewith, but it is to be understood that several such cylinders 2 and covers 3 with associated working rollers might be utilized in keeping with this invention. Moreover, as is conventional, there is provided stripper means 4 in the form of a stripper roller 5 and a pair of take-off rollers 6 and 7. The stripper means or stripper device 4 may also have associated therewith a doffer comb (not shown) or the like.

In accordance with this invention, means are provided between the stripper device 4 and the carding cylinder 2 for forming open non-woven fabric from fibrous material, and the latter includes an intermediate toothed roller 8 having sets of teeth 9 along a surface (unnumbered) thereof adjacent to which there is disposed a material guide plate 10 which converges in the direction of rotation of the roller 8, as is indicated by the unnumbered headed arrow associated therewith. Thus, the material fed between and by the intermediate roller 8 and the guide plate 10 initially enters therebetween at an initial clearance "a" which is greater than a final clearance "b" downstream from the initial clearance "a" prior to the material exiting beyond the guide plate 10. Preferably the clearance from the teeth 9 of the intermediate roller 8 and the guide plate 10 amounts to about 4 to 6 mm at the clearance "a⇄ and to about 1 mm at the clearance "b." The material guide plate 10 terminates a predetermined distance "c" from the point at which the stripper roller 5 becomes operative, i.e., ahead of the imaginary line 11 connecting the centers of the intermediate roller 8 and the stripper roller 5. The section or area "c" between the surfaces (unnumbered) of the toothed opposing rollers 5, 8 represents a free non-woven fabric-forming zone in which the jamming effect in the diminishing clearance from "a" to "b" is abrubtly discontinued or released whereby some of the fibers carried by the intermediate toothed roll 8 become detached from the teeth 9 thereof with subsequent formation of a non-woven fabric of matted fibers on the stripper roll 5. The free zone "c" for formation of the non-woven fabric may have a length of about 8 to 12 mm. If the zone selected for the formation of the non-woven fabric is too long, the throwing-off of fibers through occurring air swirls becomes too uncontrolled, and the non-woven fabric already on the stripper roller 5 becomes more irregular. When the zone where the non-woven fabric is formed is too short, the fibers are more detached mechanically and there is formed a non-woven fabric with the fibers in an undesired parallel attitude. Thus, the free length of the zone "c" is preferably approximately 10 mm, though the range latter-noted has been found acceptable.

The set of teeth 9 on the intermediate toothed roller 8 is preferably so formed that the front rake of the teeth amounts to only a few angular degrees. The toothing preferably has a front rake of zero degrees whereby the extension of the front rake of the toothing theoretically passes through the center point of the circular path (unnumbered) formed by the surface of the roller associated therewith.

The rotational speed of the carding cylinder 2 to the intermediate toothed roller 8 is preferably so coordinated one to the other that the surface speed becomes greater from cylinder to roller. The transfer factor may amount herewith to at least 1.5 upwards. The rotational speed of the intermediate toothed roller 8 to the stripper roller 5 is so coordinated that the surface speed from roller 8 to roller 5 is considerably reduced. The speed ratio from the roller 8 to the roller 5 preferably amounts to 10:1 to 100:1.

In further accordance with this invention, the means for producing the open non-woven fabric between the cylinder 2 and the roller 5 also includes suction means in the form of a suction device 13 operative at the free zone "c" for the formation of the non-woven fabric, and by means of such suction, the air from the gap or zone between the rollers 8 and 5 is drawn or carried away. In this way the formation of a non-woven fabric of matted fabrics is influenced to advantage.

The apparatus 1 of FIG. 1 is illustrated as having a carding cylinder 2 which is substantially larger than that of the intermediate toothed roller 8. The cylinder 2 preferably has a diameter of 850 to 1300 mm, whereas the intermediate toothed roller 8 preferably has a diameter of about 200 to 620 mm.

Figure 2:
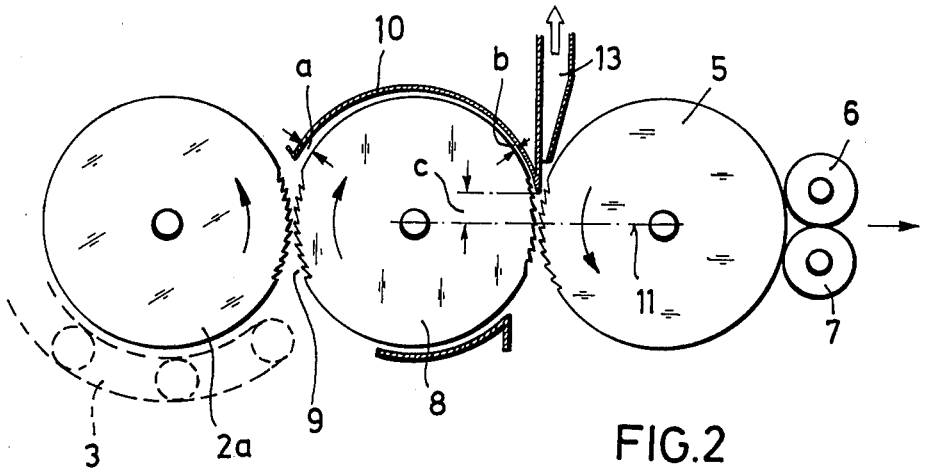
FIG. 2 is a diagrammatically side elevational view of another embodiment of the present invention, and illustrates the guide plate of FIG. 1 disposed approximately between the 12 o'clock and the 2:30 o'clock positions of the intermediate toothed roller.
Figure 3:
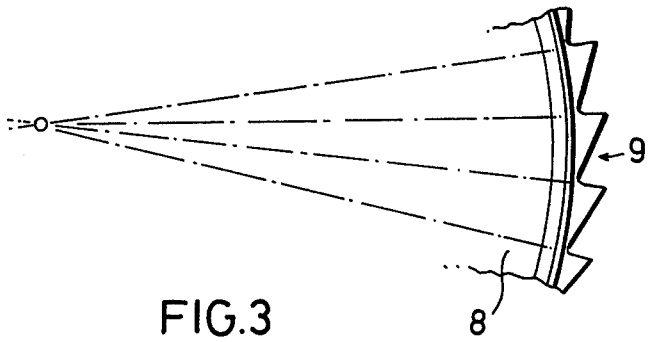
FIG. 3 is a diagrammatically fragmentary view of the intermediate toothed roller of FIGS. 1 and 2, and illustrates the formation of the teeth thereof.
Figure 2:
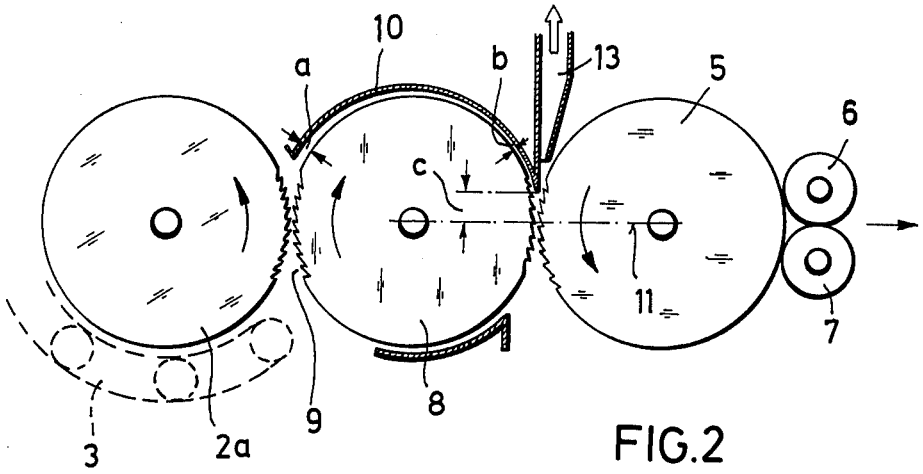
Figure 3:
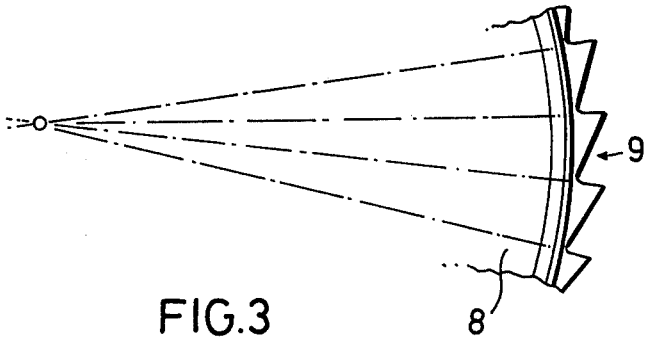

However, in the embodiment shown in FIG. 2, the carding roller **2*a* is substantially the same diameter as the intermediate toothed roller 8, i.e., both rollers 2*a* and 8 have a diameter of about 200 to 620 mm. Furthermore, in FIG. 2 the directions of rotation of the rollers 2*a*, 8 and 5 are opposite to those shown in FIG. 1, as is clearly indicated by the unnumbered headed arrows associated therewith. Accordingly, the material guide plate 10 in FIG. 2 is arranged at the upper side of the intermediate toothed roller 8. The other conditions are, however, the same as in the equipment of FIG. 1 and the values for the clearances "a," "b" and the zone "c" are also substantially the same in FIG. 2 as heretofore described relative to the embodiment of the invention illustrated in FIG. 1**.

The stripper means 4 may in a manner known per se also be so formed that instead of a stripper roller 5, the device 4 is operated with a double-stripper device.

Although only a preferred embodiment of the invention has been specifically illustrated and described herein, it is to be understood that minor variations may be made in the apparatus or in the method of without departing from the spirit and scope of the invention, as defined in the appended claims.

I claim:

1. A method of producing an open non-woven fabric from fibrous material comprising the steps of delivering fiber flocks through a carding zone during which time the fiber flocks are loosened and spread to form a non-woven fabric, subjecting the spread-out non-woven fabric to a jamming effect in a converging jamming zone defined in part by a stationary surface opposing a moving surface downstream of the carding zone to form a non-woven fabric of matted fibers, releasing the jamming effect at a downstream end of the stationary surface to form an open non-woven fabric, the releasing step being formed in an area defined by the first-mentioned moving surface and another moving surface in spaced opposed relationship thereto, the latter moving surfaces each being generally cylindrical surfaces and each having an axis of rotation, the length of the releasing area being defined between a line through the axes of the cylindrical surfaces and a downstream end of the stationary surface, and confining the open non-woven fabric during the releasing step by supporting the same through surface portions of the cylindrical surfaces during the rotation thereof from the downstream end of the stationary surface to the line through the axes of the cylindrical surfaces.

2. The method as defined in claim 1 including the step of delivering the fiber flock through the carding zone at a predetermined speed, and increasing the speed of the feed beyond the predetermined speed into the jamming zone.

3. The method as defined in claim 2 wherein the releasing of the jamming effect occurs at a decreasing speed as compared to the speed of the jamming zone.

4. Apparatus for the production of open non-woven fabric from fibrous material comprising carding means for loosening fiber flocks and spreading the same out to form a non-woven fabric, means downstream of the carding means for creating a jamming effect upon the non-woven fabric to mat the fibers thereof and form a non-woven fabric of matted fibers, means downstream of the jamming means for forming a free zone at which the jamming effect is terminated to transform the matted and non-woven fabric into an open non-woven fabric, said jamming creating means being defined by a converging path of travel between said carding means and said free zone forming means along which said non-woven fabric is conveyed and during which it is matted, said converging path of travel being defined by a surface of a rotating roller and an adjacent guide plate, said free zone forming means being in part defined by opposing moving surfaces of a pair of rollers, one of said rollers in part defining said jamming creating means, a second rotating roller having a surface opposing said first-mentioned surface, portions of said surfaces defining said free zone within which and by which the non-woven fabric is conveyed and confined during the transformation thereof to an open non-woven fabric, and said free zone being defined by portions of said surfaces between a line between axes of said rollers and a downstream end of said guide plates.

5. The apparatus as defined in claim 4 wherein said carding means is a rotating carding cylinder, and the speed of rotation of said carding cylinder is greater than the speed of rotation of said first-mentioned rotating roller.

6. The apparatus as defined in claim 5 wherein the diameter of said carding cylinder is greater than that of said first-mentioned roller.

7. The apparatus as defined in claim 5 wherein the diameter of said carding cylinder and said first-mentioned roller are approximately the same.

8. The apparatus as defined in claim 4 wherein the speed of rotation of said second rotating roller is less than the speed of rotation of said first-mentioned rotating roller.

9. The apparatus as defined in claim 4 wherein the speed of rotation of said second rotating roller is less than the speed of rotation of said first-mentioned rotating roller, and the latter speed ratio is from 10:1 to 100:1.

10. The apparatus as defined in claim 4 wherein said first-mentioned rotating roller surface is toothed and the teeth have a front rake of zero degrees to only a few angular degrees.

11. The apparatus as defined in claim 4 including means for creating a suction in said free zone to augment the formation of the open non-woven fabric.

12. The apparatus as defined in claim 4 wherein the clearance between the surfaces defining said converging path of travel diminishes from about 4 to 6 mm to approximately 1 mm.

13. The apparatus as defined in claim 4 wherein the length of said free zone is between approximately 8 to 12 mm.

* * * * *